United States Patent [19]

Hirose et al.

[11] Patent Number: 4,641,118

[45] Date of Patent: Feb. 3, 1987

[54] ELECTROMAGNET AND ELECTROMAGNETIC VALVE COIL ASSEMBLIES

[75] Inventors: Tokuzo Hirose; Ikuo Inoue, both of Osaka, Japan

[73] Assignee: Hirose Manufacturing Co., Ltd., Osaka, Japan

[21] Appl. No.: 696,433

[22] Filed: Jan. 30, 1985

[30] Foreign Application Priority Data

Aug. 6, 1984 [JP] Japan ..... 59-120856[U]
Aug. 17, 1984 [JP] Japan ..... 59-172191

[51] Int. Cl.[4] ..... H01F 7/08
[52] U.S. Cl. ..... 335/282; 336/200
[58] Field of Search ..... 335/255, 256, 266, 268, 335/282; 336/200

[56] References Cited

U.S. PATENT DOCUMENTS 2,987,655 6/1961 McCurdy ..... 335/256
3,089,106 5/1963 Saaty ..... 336/200
3,389,355 6/1968 Schroeder ..... 335/266
4,067,541 1/1978 Hunter .
4,102,526 7/1978 Hargraves .
4,157,168 6/1979 Schlagmüller et al. .
4,253,079 2/1981 Brosh ..... 336/200 X
4,326,139 4/1982 Mowbray ..... 310/27 X

*Primary Examiner*—George Harris
*Attorney, Agent, or Firm*—Wenderoth, Lind & Ponack

[57] ABSTRACT

An electromagnet including a coil unit having a plurality of electrically insulative substrates, each having a spiral conductor formed thereon, the substrates being stacked together with the spiral conductors parallel with each other. The conductors of the unit are connected in series with each other so that magnetic fluxes formed of electric currents flowing through the conductors are directed in the same direction at the central positions of the spirals of the spiral conductors, and there are formed holes at the central positions for receiving a ferromagnetic core which is moved in response to a direct electric current passed through the coil unit. A valve may be connected to the ferromagnetic core to form an electromagnetic valve assembly.

4 Claims, 10 Drawing Figures

ELECTROMAGNET AND ELECTROMAGNETIC VALVE COIL ASSEMBLIES

BACKGROUND OF THE INVENTION

1. Field of the Invention

This invention relates to an electromagnet and an electromagnetic valve.

2. Description of the Prior Art

Conventionally, as small-sized coils in electromagnets, ones comprising bobbins having copper wires wound therearound are widely used. Other coils are also used which are produced by winding adhesive copper wires cylindrically and molding thus wound wires and heat-resisting synthetic resins into coils.

Since, in general, an attracting force of an electromagnet depends on ampere-turns thereof, while heat due to an increase in electric currents must be prevented from being caused, there arises such a problem that a large-sized coil must necessarily be prepared to provide the coil with a great attracting force.

SUMMARY OF THE INVENTION

Accordingly, to solve the above problem, it is an object of the invention to provide an electromagnet and an electromagnetic valve greatly reduced in size and weight.

To accomplish the above object, the electromagnet according to the invention comprises a plurality of units each comprising a substrate made of a this electrically insulative material and having a spiral conductor formed on the surface of the substrate, the units being overlapped in parallel with each other, wherein the spiral conductors of the units are arranged to be connected in series with each other so that magnet fluxed at central positions thereof are directed in the same direction, and the units have holes formed at the central positions of the spirals of the spiral conductors.

In a preferred embodiemnt, spiral directions of the conductors in the units are identical.

In another preferred embodiment, a spiral direction of the conductor in each unit is reverse to the spiral direction of the conductor in its adjoining unit.

Besides, the electromagnet according to another aspect of the invention comprises a unit comprising a substrate made of a thin flexible electrically insulative material and having parallel conductors formed on the surface face of the substrate, the unit being formed to be cylindrical, wherein ends of the conductors in the unit are arranged to be connected in series with each other.

In a preferred embodiment, a plurality of the cylindrical units are prepared and disposed concentrically, and the conductors in the units are arranged to be connected in series with each other so that magnetic fluxes in a central space defined by the cylindrical units are directed in the same direction.

In the meantime, the electromagnetic valve according to the invention comprises a plurality of units each comprising a substrate made of a thin electrically insulative material and having a spiral conductor formed on the surface of the substrate, the units being overlapped in parallel with each other, wherein the spiral conductors of the units are arranged to be connected in series with each other so that magnet fluxes at central positions of the spirals are directed in the same direction, the units have holes formed at the central positions of the spirals of the spiral conductors, and a core comprising a ferromagnetic material for driving a valve body is arranged to be inserted through the holes movably in the axial direction thereof.

Furthermore, the electromagnetic valve according to still another aspect of the invention comprises a unit comprising a substrate made of a thin flexible electrically insulative material and having parallel conductors formed on the surface of the substrate, the unit being formed ot be cylindrical, wherein ends of the conductors in the unit are arranged to be connected in series with each other, and a core comprising a ferromagnetic material for driving a valve body is disposed in a central space defined by the cylindrical unit such that the core is capable of being displaced in the axial direction of the central space.

Consequently, in accordance with the invention, the electromagnet and electromagnetic valve comprise units made of thin electrically insulative substrates having spiral or parallel conductors formed on the surfaces thereof. Therefore the electromagnet and electromagnetic valve can be reduced in size and weight, and be compact, thereby decreasing the manufacturing cost thereof.

BRIEF DESCRIPTION OF THE DRAWINGS

These and other objects, features and advantages of the invention will become more apparent upon a reading of the following detailed specification and drawings, in which.

DETAILED DESCRIPTION OF THE PREFERRED EMBODIMENTS

Figure 1:
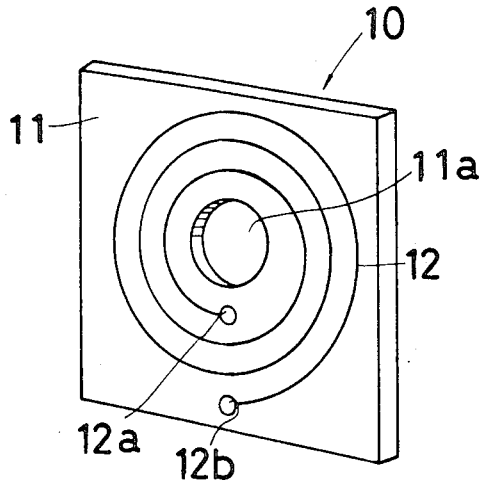
FIG. 1 is a perspective view showing a printed board of an embodiment of the invention.

Referring now to the drawings, embodiments of the invention are described below.

Figure 2:
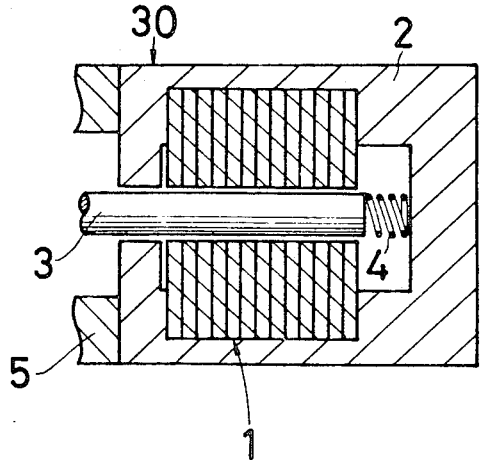
FIG. 2 is a sectional view of an electromagnet of the invention.

FIG. 1 is a perspective view of a printed board 10, in which a spiral conductor 12 is formed on the surface of a thin square electrically insulative substrate 11 having a central hole 11*a*. This conductor 12 is manufactured, for example, by a photo-etching process, that is, by gluing a copper foil to the surface of the insulative substrate 11, drawing a spiral pattern on this copper foil, applying an etching solution to the surface of the copper foil to etch the surface, leaving the pattern-drawn lines, and protecting the remaining drawn lines from being further etched. A plurality of these printed boards 10 are stacked together or overlapped in parallel relationship to each other by matching the holes 11*a* and the outer surfaces as shown in FIG. 2, and the ends of conductors of these printed boards are connected by using proper means. That is, by connecting the inner end 12*a* and outer end 12*b* of the conductor 12 between adjoining printed boards, a serially continuous long conductor is set up, and a coil 1 is formed. An iron core 3 made of a ferromagnetic material is inserted through the central holes 11*a* of this coil 1. On the other side of the iron core 3, a valve spool or the like (not shown) is integrally formed.

In an electromagnet 30, the iron core 3 is guided inside a yoke 2, and the coil 1 is provided so as to surround the outside of the iron core 3. A tension spring 4 is fixed to one end of the iron core 3. Reference numeral 5 in FIG. 2 denotes a valve casing.

The electromagnet 30, when an electric current is passed through the coil 1, causes the iron core 3 to move to the other side (to the left as viewed in FIG. 2) by overcoming the elastic force of the spring 4, and makes it still at one side when the coil 1 is not energized.

The electromagnet of this invention may be used in a fluid closing valve or direction change valve, and a coil having long conductors may be made of narrow solenoids.

Figure 3:
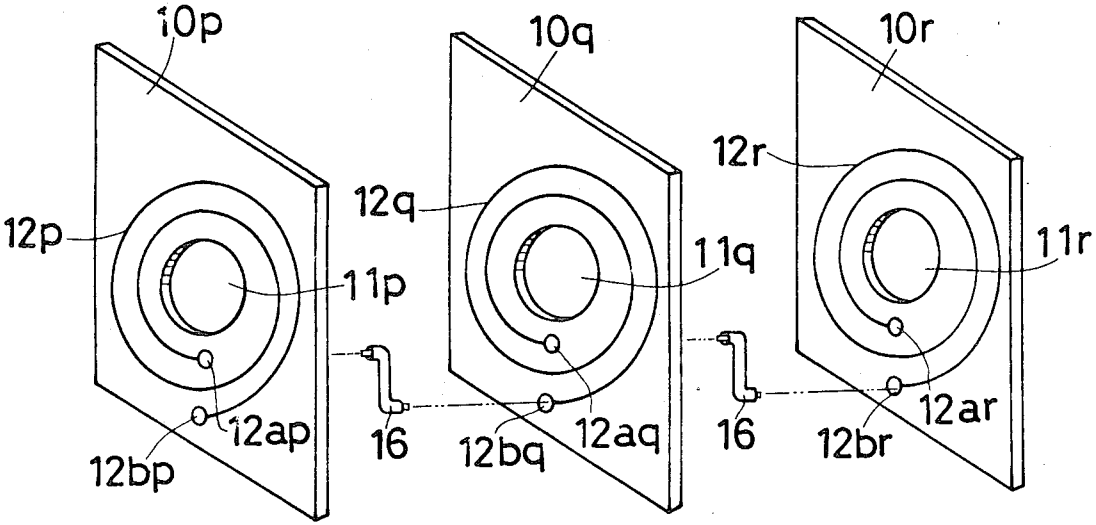
FIG. 3 is a perspective view showing printed boards of the invention.
Figure 4:
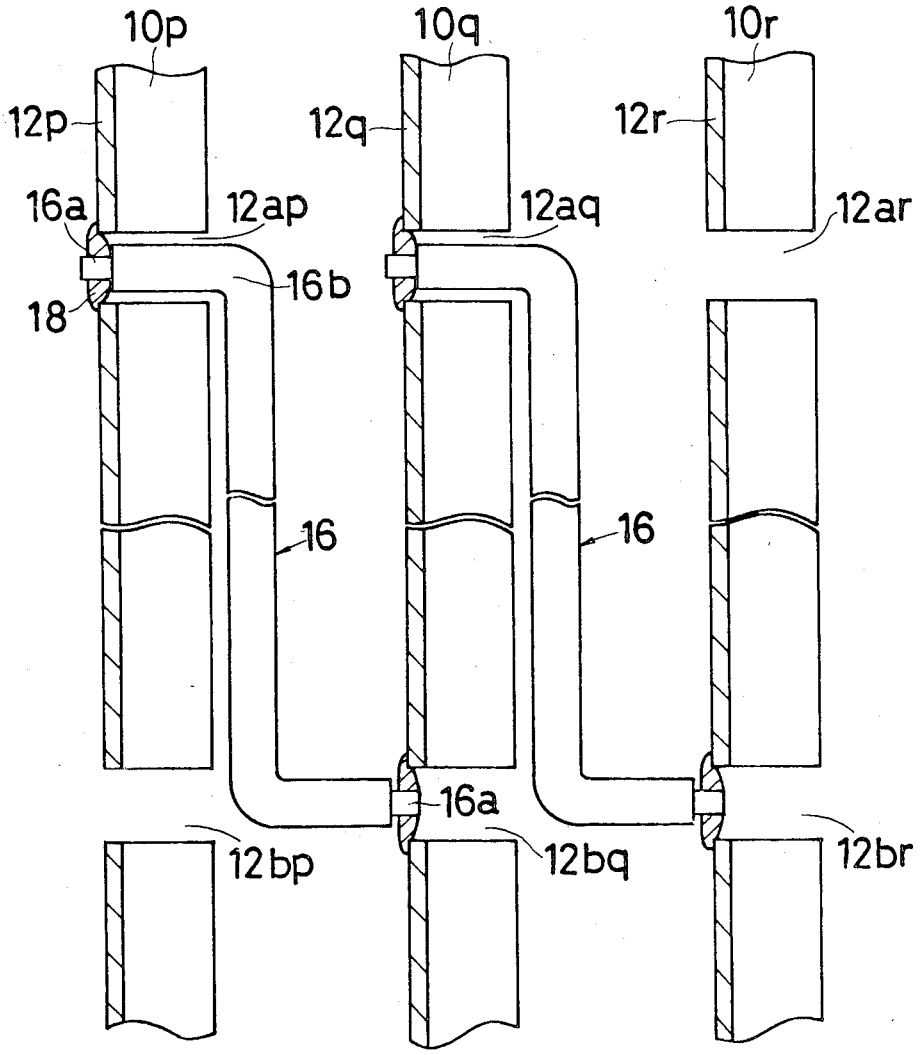
FIG. 4 is a sectional view showing ends of conductors formed on substrates and vicinities thereof.

Referring now to FIGS. 3 and 4, conductors 12*p*, 12*q*, and 12*r* are respectively formed on printed boards 10*p*, 10*q*, and 10*r* by a photo-etching technique by the use of the copper foil as mentioned above. These conductors have two hole-shaped ends 12*ap*, 12*bp*; 12*aq*, 12*bq*; 12*ar*, 12*br* respectively. The ends 12*ap*, 12*bq*; 12*aq*, 12*br* are individually connected to each other by a connecting means 16 including an electrically insulative cover 16*b* and a conductor 16*a* such as copper wire or the like covered therewith, with the help of solder 18.

Figure 5:
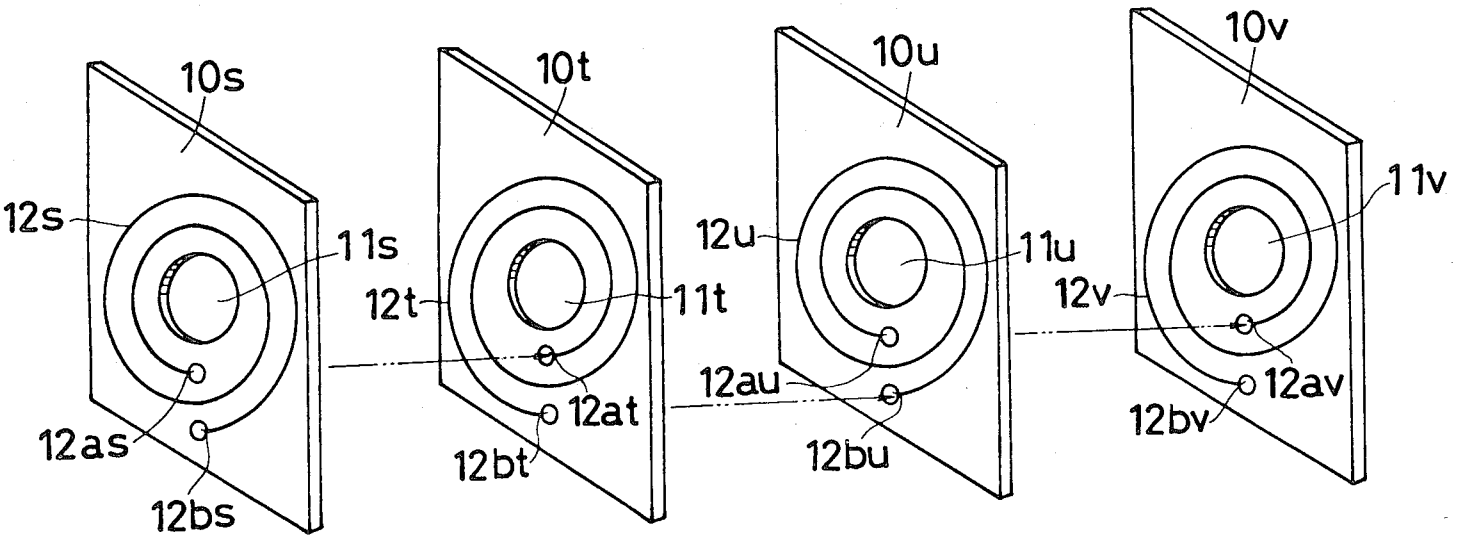
FIG. 5 is a perspective view showing printed boards of another embodiment of the invention.
Figure 6:
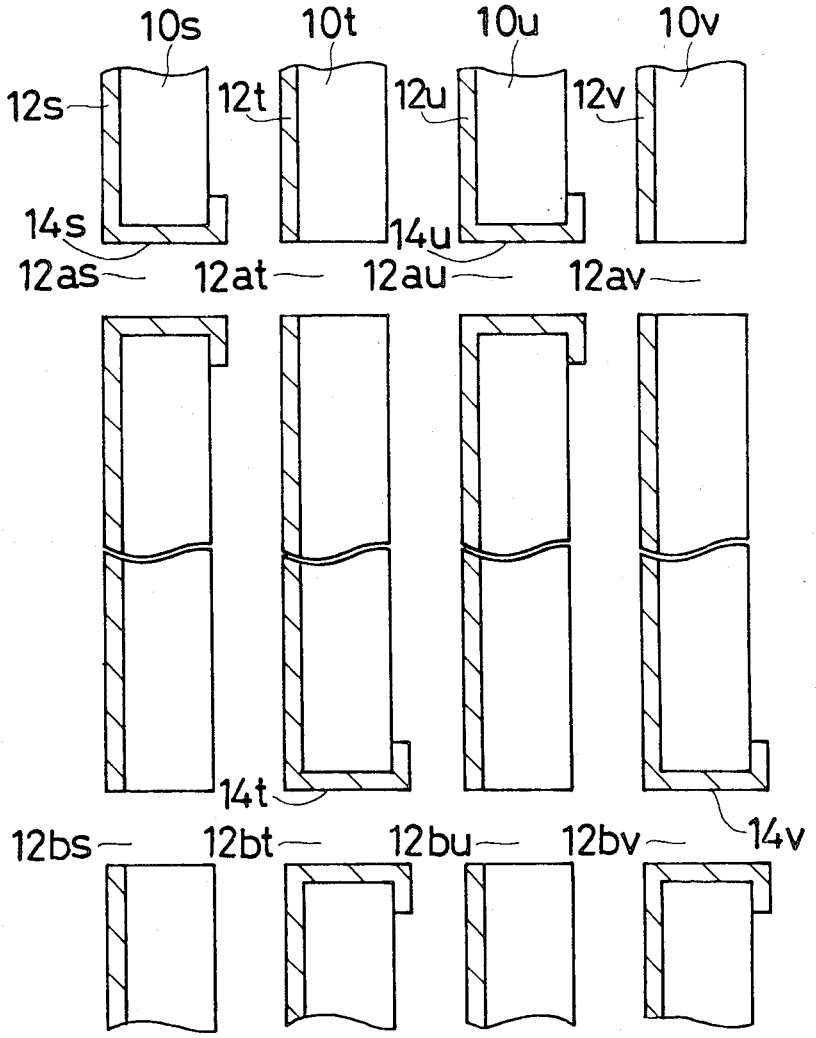
FIG. 6 is a sectional view showing ends of conductors formed on substrates and vicinities thereof.

FIG. 5 is a perspective view showing another embodiment of the invention, and FIG. 6 is a sectional view of ends 12*as*, 12*bs*; 12*at*, 12*bt*; 12*au*, 12*bu*; 12*av*, 12*bv* and the vicinities thereof. The embodiment shown in FIGS. 5 and 6 is similar to aforementioed embodiment and its corresponding parts are given the same reference marks.

Spiral conductors 12*s*, 12*t*, 12*u*, and 12*v* are respectively formed on printed boards 10*s*, 10*t*, 10*u*, and 10*v* by the photo-etching technique with the help of copper foil and the individual conductors have two hole-shaped ends 12*as*, 12*bs*; 12*at*, 12*bt*; 12*au*, 12*bu*; 12*av*, 12*bv*, as is similar to the aforementioned embodiment. it is noteworthy in this embodiment that the spiral direction of the conductor in each printed board is arranged to be reverse to that of the conductor in its adjoining printed board. Consequently, the conductors 12*s*, 12*t*; 12*t*, 12*u*; 12*u*, 12*v* are electrically connected with each other via cylindrical metal conductors 14*s*, 14*t*, 14*u*, and 14*v* respectively instead of the connecting means 16 as in the foregoing embodiment.

Figure 7:
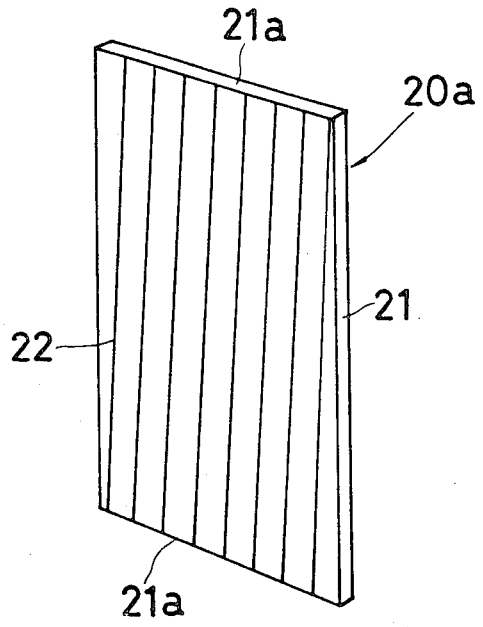
FIG. 7 is a perspective view of a flat printed board of still another embodiment of the invention.
Figure 8:
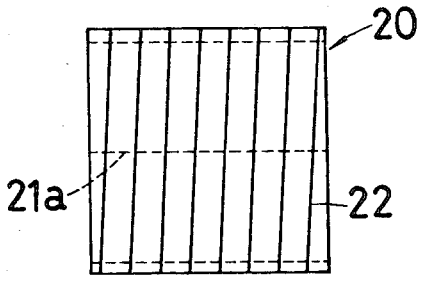
FIG. 8 is a front view of a printed cylinder of the invention.
Figure 9:
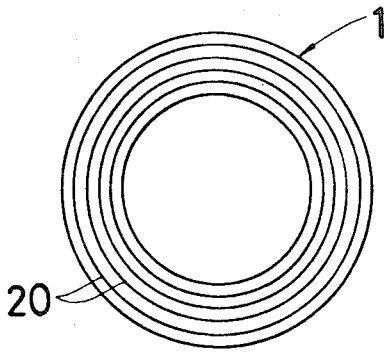
FIG. 9 is a side view of a coil of the invention.

FIGS. 7 to 9 show another embodiment of the coil, and the coil 1 is an assembled body of printed cylinders 20. Namely, a plurality of parallel linear conductors 22 are formed at equal intervals along the widthwise direction on the surface of a thin rectangular electrically insulative substrate 21, being inclined toward lengthwise direction edges 21*a*, so as to make up a flat printed board 20*a*. The board is bent along the lengthwise direction thereof to be cylindrical, upper and lower edges 21*a* are bonded with each other, and then the ends of each linear conductor 22 and connected with corresponding ends of adjoining linear conductors 22, thus forming a printed cylinder 20. A plurality of such printed cylinders 20 differing from one another in diameter are formed by the use of a plurality of electrically insulative substrates 21 differing from one another in length. A set of these printed cylinders is made which is concentrically put together with slight spaces. Ends of the linear conductors 22 in these printed cylinders 20 are respectively connected in series, thereby forming the coil 1. Incidentally, forming method of the linear conductors 22 is the same as in the foregoing embodiment.

Figure 10:
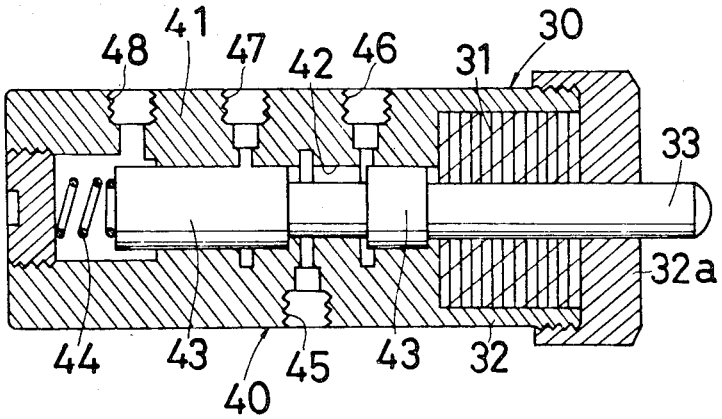
FIG. 10 is a sectional view of an electromagnetic valve of the invention.

In another embodiment resembling the one in FIG. 2, as shown in FIG. 10, an electromagnet 30 has an iron core 33 which is guided inside a yoke 32, and a coil 31 is provided so as to surround the outside of this iron core. the coil 31 is detached by removing a cap 32*a* screwed on the yoke 32. The other concentric side of the iron core 33 is a spool 43 of a valve 40.

The valve 40 shown in this embodiment is a two-way valve, having a valve hole 42 in which the spool 43 is slidably provided inside valve casing 41 which is formed integrally with said yoke 32, and also having three connection ports 45, 46 and 47. At the anti-electromagnet side of the spool 43 is provided a spring 44 for pressing the spool towards the electromagnet side. Reference numeral 48 designates a drain port.

In this electromagnet 30, when the coil 31 is not energized, as shown in FIG. 10, the spool 43 stands still at one side (on the right side as viewed in FIG. 10), and a first passage to communicate two connection ports 45, 46 with each other is opened. when a direct current is passed or flowed through the coil 31, the electromagnet 30 is actuated to move the iron core 33 and spool 43 to the other side (to the left as viewed in FIG. 10) by overcoming the elastic force of the spring 44, whereby the first passage is closed, and at the same time a second passage to communicate the two connection ports 45, 47 with each other is opened.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electromagnet comprising:

a plurality of first planar insulative substrates, each having a spiral shaped conductor on only one side thereof, each spiral shaped conductor extending in a first direction between a radially inner terminal end and a radially outer terminal end thereof;

a plurality of second planar insulative substrates, each having a spiral shaped conductor on only one side thereof, each spiral shaped conductor extending in a second spiral direction between a radially inner terminal end and a radially outer terminal end thereof, said second spiral direction being a reverse of said first spiral direction;

said plurality of first planar insulative substrates being stacked in alternating relationship with said plurality of second planar insulative substrates, the stack of said plurality of first and second planar insulative substrates having a hole extending centrally therethrough with respect to each spiral shaped conductor;

each of said plurality of first planar insulative substrates having said radially inner terminal end connected to a cylindrical conductor extending therethrough and electrically connected to an abutting radially inner terminal end on a respective one of said plurality of second planar insulative substrates;

each of said plurality of second planar insulative substrates having said radially outer terminal end connected to a cylindrical conductor extending therethrough and electrically connected to an abutting radially outer terminal end on a respective one of said plurality of first planar insulative substrates, whereby each sprial shaped conductor is electrically connected together in series;

a housing having said stack of planar insulative substrates mounted therein; and a ferromagnetic core slidably received in said hole in said stack of planar insulative substrates, said ferromagnetic core being moved with respect to said stack of planar insulative substrates when a direct electric current is passed through each spiral shaped conductor of said stack of planar insulative substrates.

2. An electromagnetic valve comprising:

a plurality of first planar insulative substrates, each having a spiral shaped conductor on only one side thereof, each spiral shaped conductor extending in a first direction between a radially inner terminal end and a radially outer terminal end thereof;

a plurality of second planar insulative substrates, each having a spiral shaped conductor on only one side thereof, each spiral shaped conductor extending in a second spiral direction between a radially inner terminal end and a radially outer terminal end thereof, said second spiral direction being a reverse of said first spiral direction;

said plurality of first planar insulative substrates being stacked in alternating relationship with said plurality of second planar insulative substrates, the stack of said plurality of first and second planar insulative substrates having a hole extending centrally therethrough with respect to each spiral shaped conductor;

each of said plurality of first planar insulative substrates having said radially inner terminal end connected to a cylindrical conductor extending therethrough and electrically connected to an abutting radially inner terminal end on a respective one of said plurality of second planar insulative substrtes;

each of said plurality of second planar insulative substrates having said radially outer terminal end connected to a cylindrical conductor extending therethrough and electrically connected to an abutting radially outer terminal end on a respective one of said plurality of first planar insulative substrates, whereby each spiral shaped conductor is electrically connected together in series;

a housing having said stack of planar insulative substrates mounted therein; and a ferromagnetic core slidably received in said hole in said stack of planar insulative substrates, said ferromagnetic core having one end extending from said stack of planar insulative substrates and being moved with respect to said stack of planar insulative substrates when a direct electric current is passed through each spiral shaped conductor of said stack of planar insulative substrates;

a valve casing surrounding said one end of said ferromagnetic core; and valve means including a valve disposed in said valve casing, said valve means attached to said one end of said ferromagnetic core for opening and closing said valve in response to movement of said ferromagnetic core when direct electric current is passed through each spiral shaped conductor of said stack of planar insulative substrates.

3. An electromagnet comprising:

a coil unit, said coil unit including at least one thin flexible electrically insulative substrate having parallel conductors formed thereon, said thin flexible electrically insulative substrate being formed into a cylindrical shape with first ends of said parallel conductors being connected to second ends of respective adjacent parallel conductors whereby said parallel conductors are electrically connected in series;

a housing having said coil unit mounted therein; and a ferromagnetic core slidably mounted in said housing with said thin flexible electrically insulative substrate formed into a cylindrical shape surrounding said ferromagnetic core, said ferromagnetic core being moved with respect to said coil unit by passing a direct current through said parallel conductors which are electrically connected in series.

4. The electromagnet of claim 3, comprising a plurality of flexible electrically insulative substrates which are formed into a plurality of coaxial cylindrical shapes to form said coil unit.

* * * * *